US005709808A

United States Patent [19]

Lee

[11] Patent Number: 5,709,808

[45] Date of Patent: Jan. 20, 1998

[54] FORMWORK TO BE USED WITH A WALL FORM ASSEMBLY FOR FORMING A DOOR OPENING IN A CONCRETE WALL

[76] Inventor: Kuo-An Lee, No. 851, Chung-Shan Rd., Nan-Shing Tsun, Kui-Jen Hsiang, Tainan Hsien, Taiwan

[21] Appl. No.: 677,451

[22] Filed: Jul. 2, 1996

[51] Int. Cl.[6] ..... E04G 15/02

[52] U.S. Cl. ..... 249/39; 249/155; 249/157; 249/178

[58] Field of Search ..... 249/39, 155, 157, 249/178

[56] References Cited

U.S. PATENT DOCUMENTS 4,679,763 7/1987 Brotherton ..... 249/155

5,219,473 6/1993 Sandwith ..... 249/155

*Primary Examiner*—Thomas R. Weber

*Attorney, Agent, or Firm*—Merchant, Gould, Smith, Edell, Welter & Schmidt, P.A.

[57] ABSTRACT

A formwork is to be used with a wall form assembly for forming a door opening in a concrete wall. The formwork mainly includes a parallel pair of mold frame members that are to be disposed between a parallel pair of wall form plates which confine a concrete pouring space for forming a concrete wall, and that are adapted to be mounted to the wall form plates. The mold frame members have partition plates that extend toward and that overlap one another. The partition plates are movable with the mold frame members towards and away from each other and confine a door opening that is isolated from the concrete pouring space. The formwork is easy to assemble and disassemble, is suitable for large-scale construction, and is adjustable to fit the size of the door frame that is to be installed.

12 Claims, 9 Drawing Sheets

FORMWORK TO BE USED WITH A WALL FORM ASSEMBLY FOR FORMING A DOOR OPENING IN A CONCRETE WALL

BACKGROUND OF THE INVENTION

1. Field of the Invention

This invention relates to a formwork for concrete structures, more particularly to a formwork to be used with a wall form assembly for forming a door opening in a concrete wall.

2. Description of the Related Art

Conventionally, when constructing concrete structures, a large number of wooden wall form plates are nailed together to confine a concrete pouring space within which steel bars are to be erected and concrete is to be poured, thereby forming the concrete wall. Modular wall form assemblies which permit efficient and high-quality construction of concrete structures have been developed and have been widely popular in recent years.

In order to form a predetermined opening, such as a door opening, a window opening, an opening for installing an air conditioner, etc., partition plates are positioned within the wall form assembly between two wall form plates and are interconnected to confine an opening therethrough. After concrete has been poured and the concrete wall hardens, the partition plates and the wall form assembly can be disassembled and removed from the concrete wall, thereby forming the opening which has a size that is generally larger than the frame to be fixed therein. The window or door frame is then attached to the opening in the concrete wall. The gaps that are formed between the frame and the concrete wall are patched with cement so as to securely fix the frame to the concrete wall. This is the so-called post-install type concrete pouring method. During the construction of the forms, wooden panels for forming the door or window opening should be nailed so that they are interconnected to confine the opening. These wooden panels are disassembled and eventually destroyed after the concrete hardens. Wooden panels should be nailed and assembled again at another place where another door or window opening is to be formed. Such a method for constructing and disassembling the panels is obviously inferior to the modular wall form assembly, especially in the large-scale construction of similar houses, since it is inconvenient, requires a large amount of manpower, and the quality of the resulting product is relatively poor.

A pre-install type concrete pouring method has been suggested, whereby a frame can be temporarily positioned when pouring concrete to form a concrete structure in such a manner that the frame is connected securely to the concrete wall of the structure after the concrete hardens. Although the suggested method saves manpower, reduces the construction period, and results in high efficiency and high quality, it still has the following drawbacks. When the thickness of the door frame is greater than that of the wall to be formed, the door frame cannot be disposed between the wall form panels. Moreover, since the door frame has been previously fixed to the opening in the concrete wall and the position thereof is not adjustable, an error might be created which is difficult to solve during subsequent installation of the door. Furthermore, by the use of this method, the door frames should be prepared at the beginning of the construction, thereby resulting in an early expense for the purchase of the door frames. Moreover, the pre-installed door frames, however, are easily twisted due to weather factors and should be protected during the construction period. This results in the need for extra treatment and extra costs.

SUMMARY OF THE INVENTION

Therefore, the main object of this invention is to provide a formwork to be used with a wall form assembly for forming a door opening. The formwork of this invention is suitable for large-scale construction and solves the problem of differences between the thickness of the door frame and that of the concrete wall so that the construction can be precisely performed.

Another object of the present invention is to provide a formwork which confines a liquid-tight space for forming the door opening.

Yet another object of the present invention is to provide a flexible formwork which is adjustable to fit the thickness of the concrete wall and which confines a liquid-tight space for forming a door opening.

Accordingly, the formwork of the present invention is adapted to be used with a wall form assembly which includes a parallel pair of spaced wall form plates that confine a concrete pouring space for forming a concrete wall therebetween. The formwork is to be disposed between the wall form plates so as to form a door opening in the concrete wall. The formwork of the present invention includes a parallel pair of spaced mold frame members. Each of the mold frame members has a peripheral portion provided with a partition plate that extends toward the other one of the mold frame members. The partition plates of the mold frame members overlap one another and are in sealing contact with each other. The partition plates are movable with the mold frame members toward and away from each other. The partition plates confine the door opening which is isolated from the concrete pouring space. The formwork of the present invention is easy to assemble and disassemble and is thus suitable for use in large-scale construction. Moreover, the formwork of the present invention is adjustable to fit the size of the door frame.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
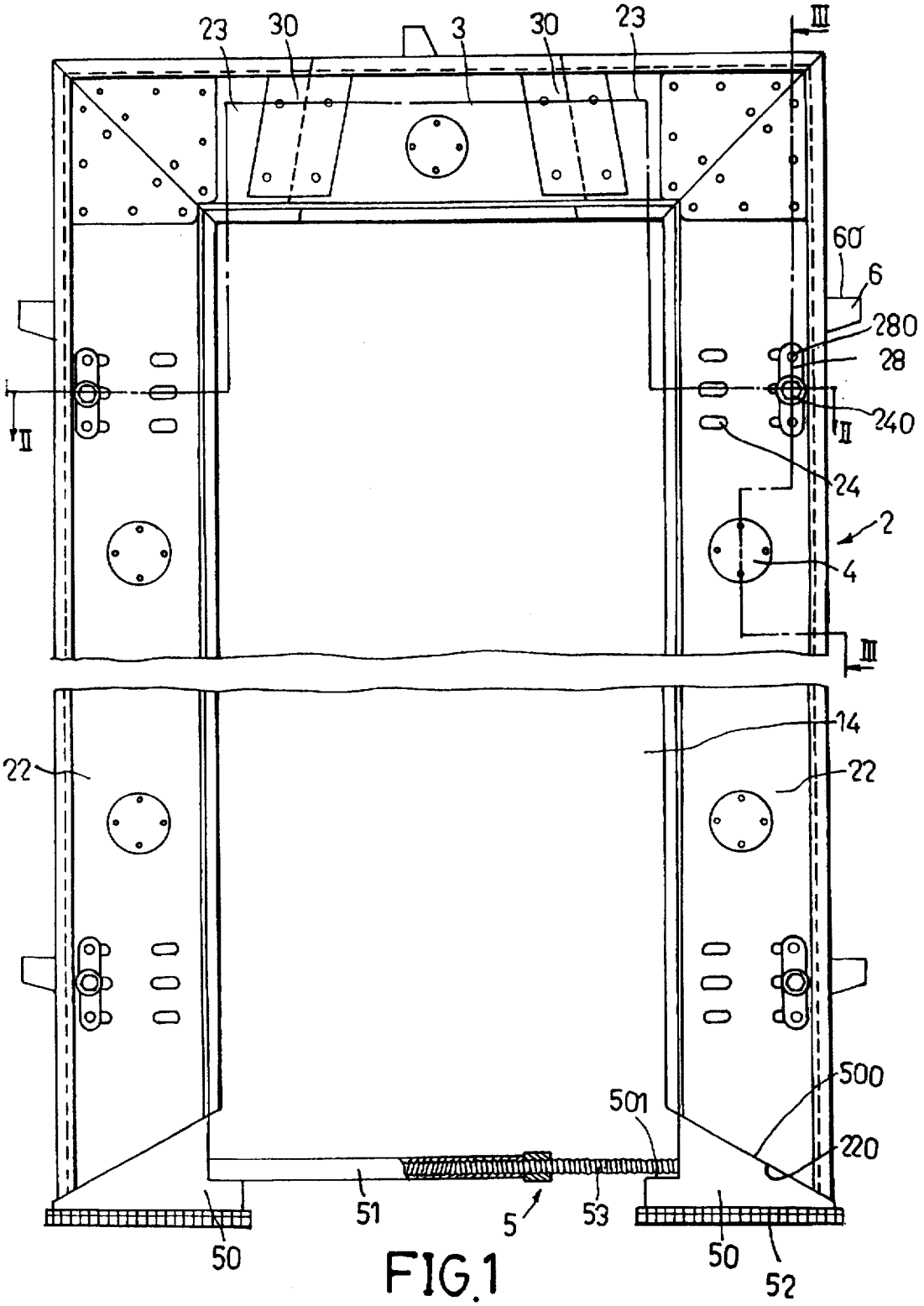
FIG. 1 is a front view of a preferred embodiment of the formwork of the present invention.
Figure 2:
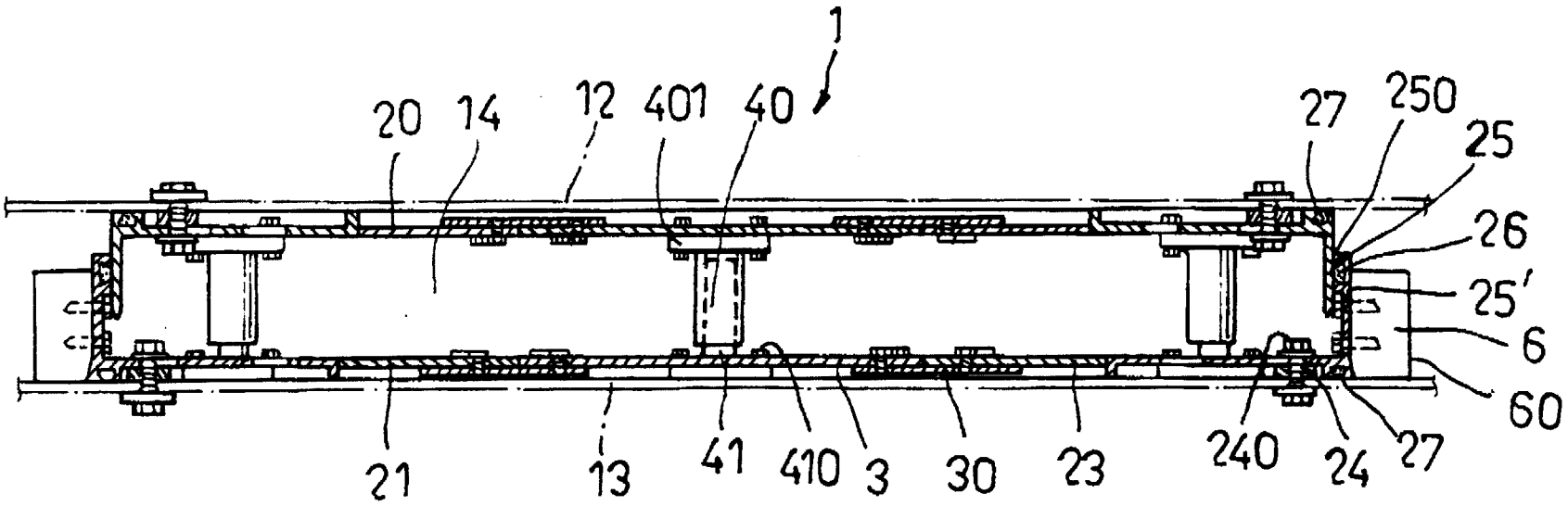
FIG. 2 is a sectional view of the preferred embodiment, taken along line II—II in FIG. 1.
Figure 3:
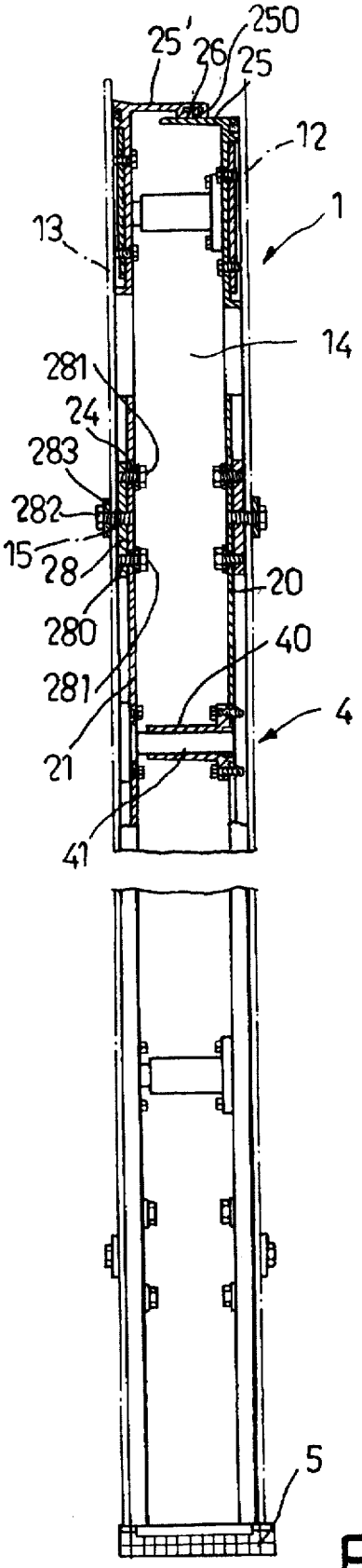
FIG. 3 is a sectional view of the preferred embodiment, taken along line III—III in FIG. 1.

Referring to FIGS. 1, 2 and 3, a formwork of a preferred embodiment of the present invention for forming a door opening to be installed with a metal door frame is shown. The formwork is mounted at the periphery of a door opening 14 in a wall form assembly 1 which includes a front wall form plate 12 and a rear wall form plate 13 that confine a concrete pouring space for forming a concrete wall therebetween. The formwork 2 mainly includes a front mold frame member 20 and a rear mold frame member 21, a pair of horizontal panels 3, a plurality of guide units 4, two pairs of wedge members 5 and a plurality of projecting mold members 6. Each of the mold frame members 20, 21 includes a pair of vertical panels 22.

The front mold frame member 20 and the rear mold frame member 21 are mounted respectively to the pair of wall form plates 12, 13 at the periphery of a door opening 14 in the wall form plates 12, 13. Each of the mold frame members 20, 21 includes a pair of vertical panels 22 which are disposed at two sides of the door opening 14. Each of the vertical panels 22 has a top end formed with an extension 23 having an inclined edge. Each of the vertical panels 22 is formed with two sets of six horizontally extending slots 24 at upper and lower portions of the vertical panel 22, respectively. A plurality of bolts 240 pass through the slots 24 for securing the mold frame members 20, 21 to the wall form plates 12, 13 such that the front mold frame member 20 is threadedly mounted to the front wall form plate 12 while the rear mold frame member 21 is threadedly mounted to the rear wall form plate 13. Each of the mold frame members 20, 21 has a peripheral portion provided with a partition plate 25, 25'. The partition plates 25, 25' are movable with the mold frame members 20, 21 toward and away from each other. The outer sides of the partition plates 25, 25' form a step 250 with a predetermined height. A seal strip 26 is provided between the partition plates 25, 25'. The peripheral portion of each of the mold frame members 20, 21 is also provided with a seal strip 27 which is adapted to contact sealingly the respective one of the wall form plates 12, 13. Each of the vertical panels 22 has an inclined bottom edge 220 which descends from the inner side of the vertical panel 22 toward the outer side of the same.

As mentioned beforehand, the mold frame members 20, 21 are mounted to the wall form plates 12, 13 by means of the bolts 240. Each set of the six horizontally extending slots 24 at the upper or lower portion of each of the vertical panels 22 are arranged into two lines, i.e., three slots 24 in each line. An elongated plate member 28 is attached selectively to one of the two lines of slots 24. The elongated plate member 28 is formed with three through holes 280 which are registered respectively with the three slots 24 in the selected line. Each of the wall form plates 12, 13 is further formed with a through hole 15 which is registered with a middle one of the three through holes 280 in the elongated plate member 28 that is attached to the vertical panel 22. Two bolts 281 are threaded from the inner side of the wall form plates 12, 13 through an upper one and a lower one of the three slots 24 and through an upper one and a lower one of the three through holes 280 to secure the elongated plate member 28 to one of the mold frame members 20, 21. Another bolt 282, together with a washer 283, is threaded into a middle one of the three through holes 280 from the outer side of the wall form plates 12, 13, thereby securing the mold frame members 20, 21 to the wall form plates 12, 13 such that the positions thereof are slightly adjustable after the formwork 2 is assembled.

The pair of horizontal panels 3 are identical in cross-section with the mold frame members 20, 21. Each of the horizontal panels 3 is disposed between and is connected removably to the extensions 23 formed at the top end of the vertical panels 22. Each of the extensions 23 has an inclined edge. The horizontal panel 3 is substantially trapezoid in shape and has a narrower top end, a wider bottom end, and inclined sides which complement the inclined edges of the extensions 23. A pair of connecting boards 30 are fixed threadedly to joint portions of the extensions 23 and the horizontal panel 3 so as to interconnect the pair of extensions 23 and the horizontal panel 3. The horizontal panel 3 of this invention can be replaced with one having a different size so as to adjust the width of the door opening confined by the mold frame members 20, 21.

Several guide units 4 are disposed between the mold frame members 20, 21 at predetermined positions. Each of the guide units 4 includes a tubular sleeve 40 and a shaft 41. The tubular sleeve 40 has one end formed as a sleeve base 401 which is mounted to the front mold frame member 20. The shaft 41 has one end formed as a shaft base 410 which is mounted to the rear mold frame member 21, and an opposite end extending slidably into the tubular sleeve 40. The shaft 41 and the tubular sleeve 40 slide relative to each other to guide movement of the mold frame members 20, 21 towards and away from each other.

Each of the wedge members 50 has a substantially triangular cross-section and an inclined face 500. Each pair of wedge members 50 supports the inclined bottom edges 220 of the vertical panels 22 of one of the mold frame members 20, 21 thereon. Each of the wedge members 50 has an inner side formed with a shoulder 501. The formwork 2 of the preferred embodiment of the present invention further includes an externally threaded rod 53 having one end which abuts against one of the wedge members 50, and an internally threaded elongated socket 51 having one end which abuts against the other one of the wedge members 50 and which rests on the shoulder 501. Each of the wedge members 50 has a bottom side which is preferably provided with a seal strip 52 to fill the gap below the mold frame members 20, 21 so as to prevent the leakage of concrete into the door opening 14.

The projecting mold members 6 are fixed to an outer one of the partition plates 25, 25' and are located at predetermined positions. The projecting mold members 6 are preferably trapezoid in shape and gradually contract outwards.

To assemble the formwork 2 of the preferred embodiment of the present invention, a pair of horizontal panels 3 having a suitable length, which is selected according to the width of the door opening 14 to be formed, are inserted and mounted to the mold frame members 20, 21. The front mold frame member 20 is mounted to the periphery of the door opening 14 in the front wall form plate 12, which has been disposed in a predetermined position. The shaft 41 on the rear mold frame member 21 is slidably inserted into the sleeve 40 on the front mold frame member 20. The shaft 41 and the sleeve 40 can move with the rear and front mold frame members 20, 21 towards and away from each other such that the two mold frame members 20, 21 are parallel with each other and such that the partition plates 25, 25' of the two mold frame members 20, 21 are in sealing contact with each other and are movable with the mold frame members 20, 21 toward and away from each other. A bolt 240 is threaded into the through hole 24 from the inner side of the rear mold frame member 21 to fix the rear mold frame member 21 to the rear wall form plate 13. The distance between the two mold frame members 20, 21 is adjustable in accordance with the thickness of the concrete wall to be built since they can be moved toward and away from each other while maintaining an excellent sealing effect. A pair of wedge members 50, each of which is provided with a seal strip 52 at the bottom side thereof, are disposed at the bottom sides of the vertical panels 22 of each of the mold frame members 20, 21. The length of the externally threaded rod 53 within the internally threaded elongated socket 51 is adjusted such that the free ends of the rod 53 and the socket 51 abut against the two wedge members 50. Thus, the wedge members 50 and the seal strips 52 are positioned securely below the formwork 2 to prevent the leakage of concrete. In this way, the partition plates 25, 25' of the mold frame members 20, 21 confine the door opening 14 which is isolated from the concrete pouring space defined by the two wall form plates 12, 13 to form the concrete wall. Of course, the formwork 2 which includes the mold frame members 20, 21, the horizontal panel 3, the guide units 4, the wedge members 50, the rod 53 and the socket 51 may be assembled first and then mounted to the front wall form plate 12. The rear wall form plate 13 is subsequently mounted to the other side of the assembled formwork 2.

To strip the formwork 2, the rod 53 and the socket 51 are initially removed. Then, the formwork 2 can be contracted and released from the wall form plates 12, 13 to which it has been previously mounted. The wall form plates 12, 13 are then brought away from the two sides of the wall, thereby resulting in a concrete wall with a door opening 14 formed therein. A plurality of cavities 60 for retaining fastening members used for subsequent installation of a door frame are formed at the periphery of the door opening 14 in the concrete wall due to the presence of the projecting mold members 6 on an outer one of the partition plates 25, 25'. The formwork and the wall form plates 12, 13 can be used repeatedly at different places. However, the horizontal panel 3 may be replaced with one having a suitable length to fit the size of the width of the door opening 14 to be formed.

Figure 4:
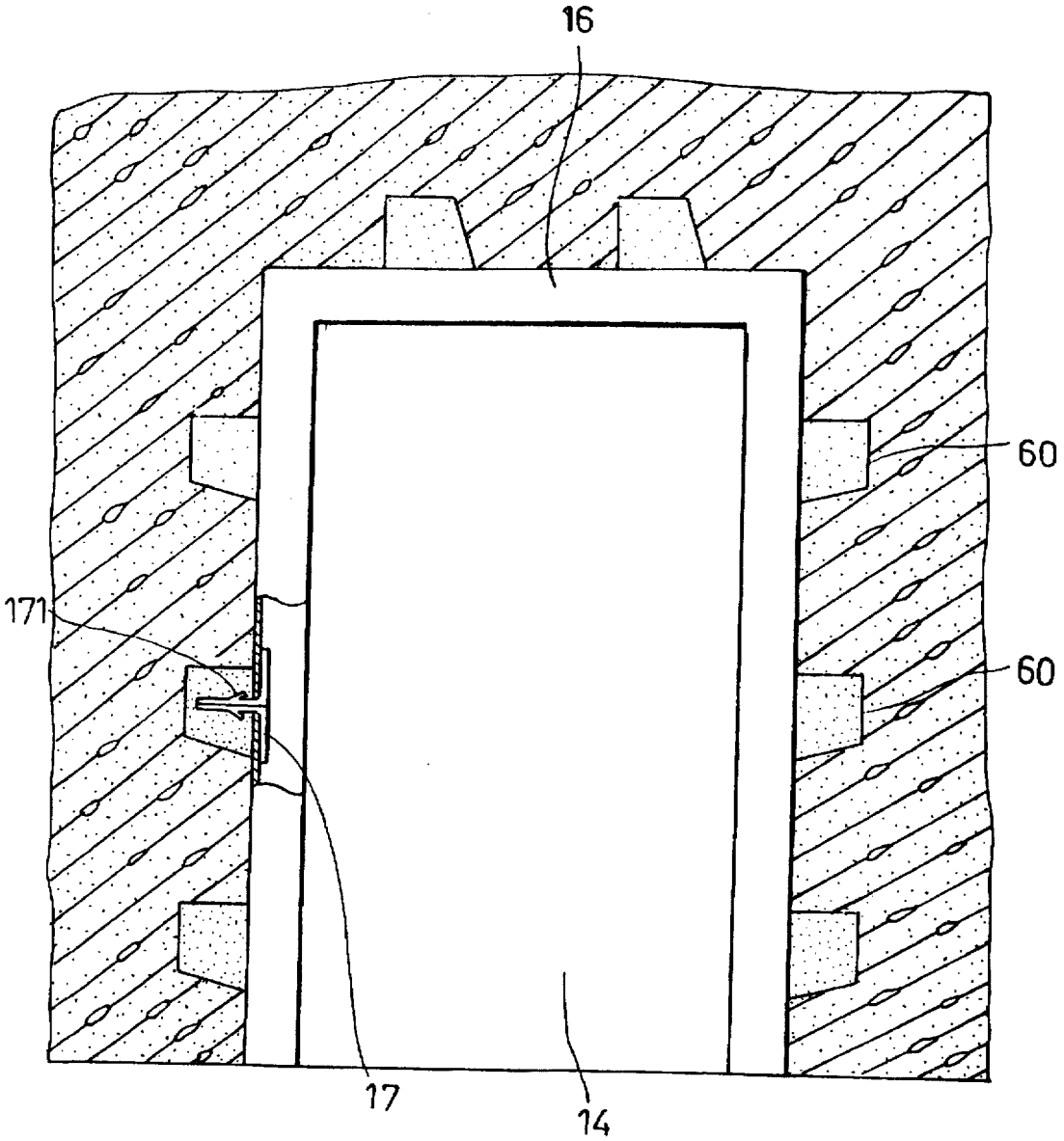
FIG. 4 is a front view of the door opening formed with the use of the preferred embodiment of FIG. 1 after a door frame has been installed therein.
Figure 5:
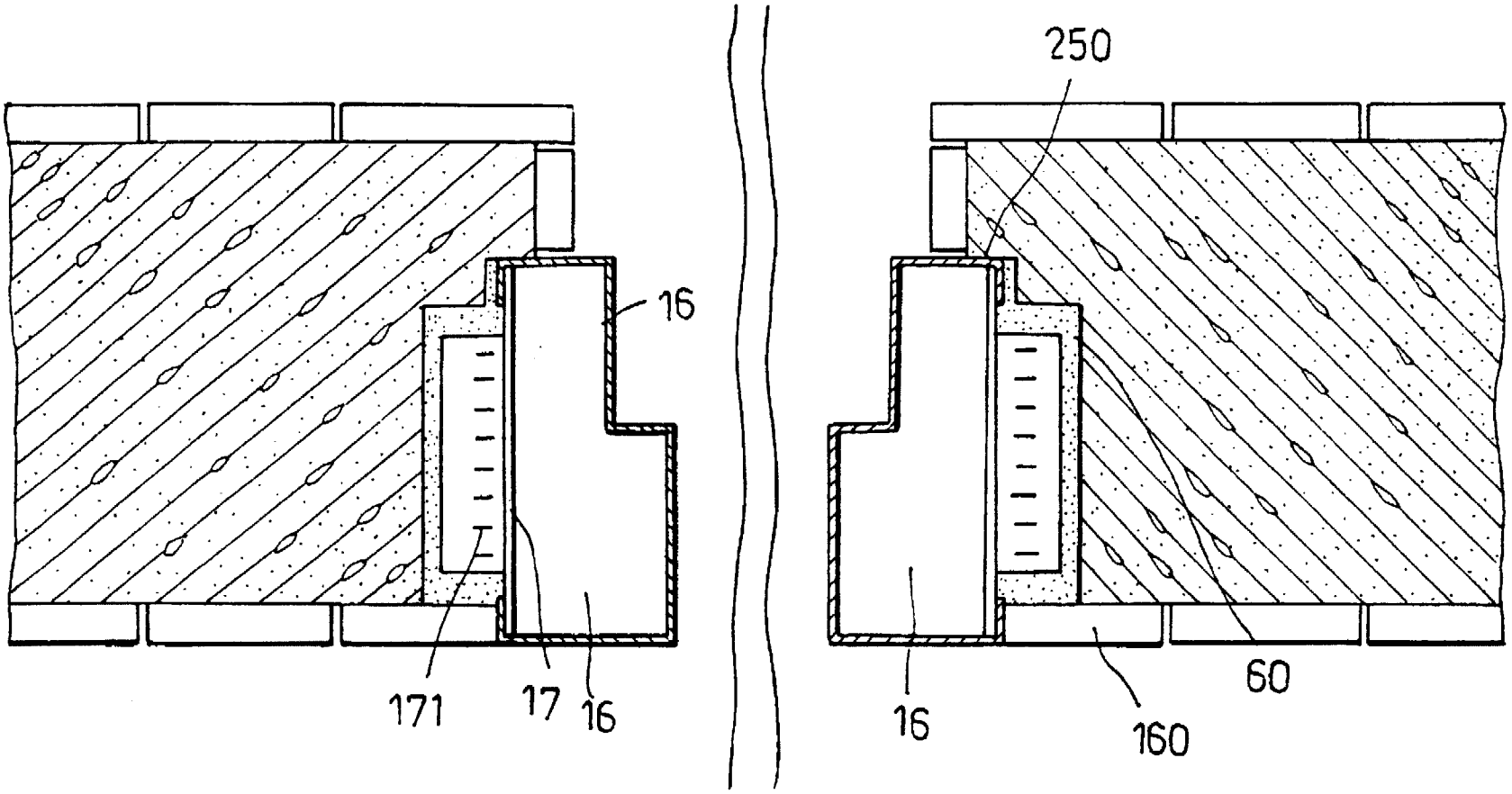
FIG. 5 is a cross-sectional view of the concrete structure shown in FIG. 4.

Referring to FIGS. 4 and 5, to install a door frame 16 in the door opening 14 formed previously by with the use of the formwork of this invention, a plurality of fastening members 17 are provided on the door frame 16 at predetermined positions corresponding to the cavities 60 formed in the concrete wall. The door frame 16 is provided with fastening members 17 and is positioned in the door opening 14. The door frame 16 abuts against the step 250 formed on the outer sides of the partition plates 25, 25'. Each of the fastening members 17 extends into one of the cavities 60 such that a middle portion 171 of each of the fastening members 17 is suspended in the cavity 60. Concrete is then poured into the cavities 60 such that the door frame 16 is fixed to the door opening 14 to become an integral part of the concrete wall.

Figure 6:
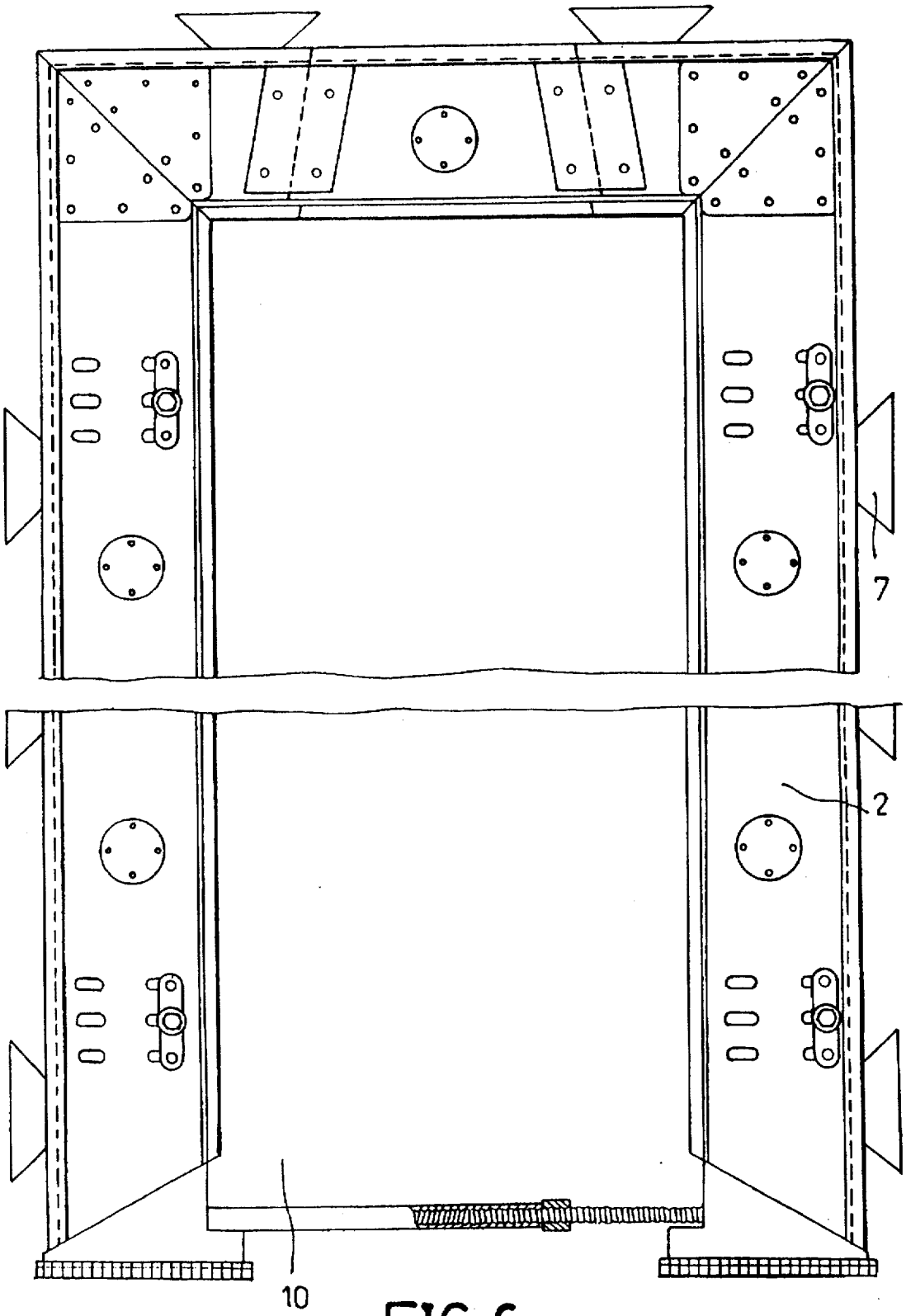
FIG. 6 is a front view of a second preferred embodiment of the formwork of the present invention.
Figure 7:
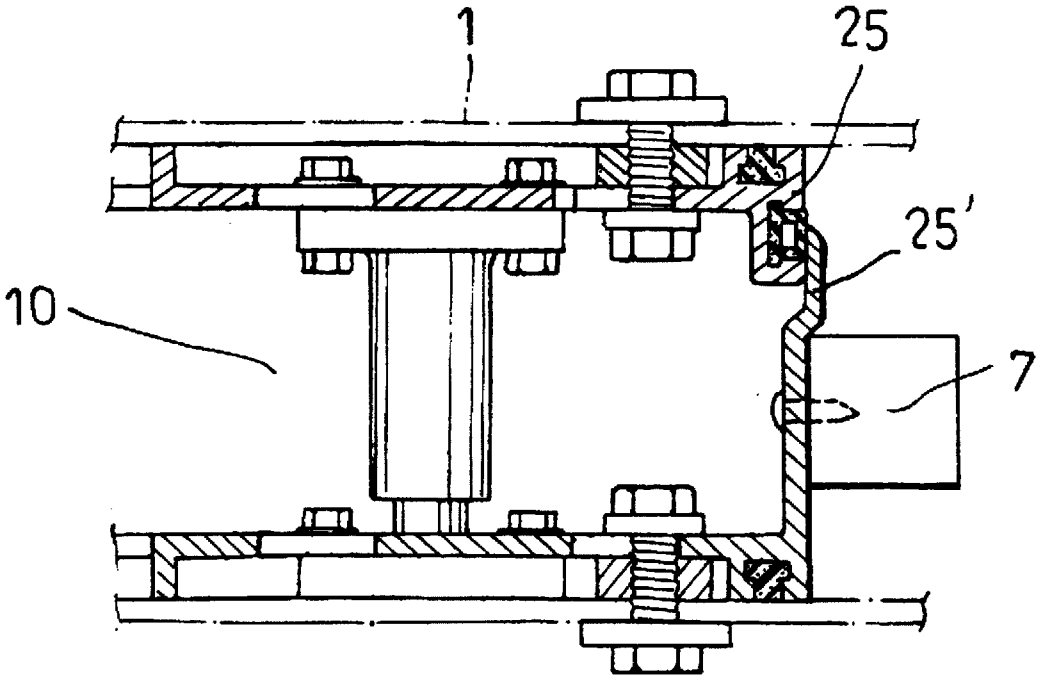
FIG. 7 is a sectional view of the preferred embodiment shown in FIG. 6.

FIGS. 6 and 7 illustrate a second preferred embodiment of the formwork of the present invention for forming a door opening to be installed with a wooden door frame. In this preferred embodiment, a plurality of wooden positioning blocks 7 replace the projecting mold members 6 of the formwork 2 of the first embodiment. The wooden positioning blocks 7 are mounted removably to an outer one of the partition plates 25, 25' of the mold frame members 20, 21. The wooden positioning blocks 7 are trapezoid in shape and gradually diverge outward. To strip the formwork 2 of this embodiment, the wooden positioning blocks 7 are removed from the mold frame members 20, 21 and are left embedded in the concrete wall. In this embodiment, the outer sides of the partition plates 25, 25' do not form a step with a substantial height.

Figure 8:
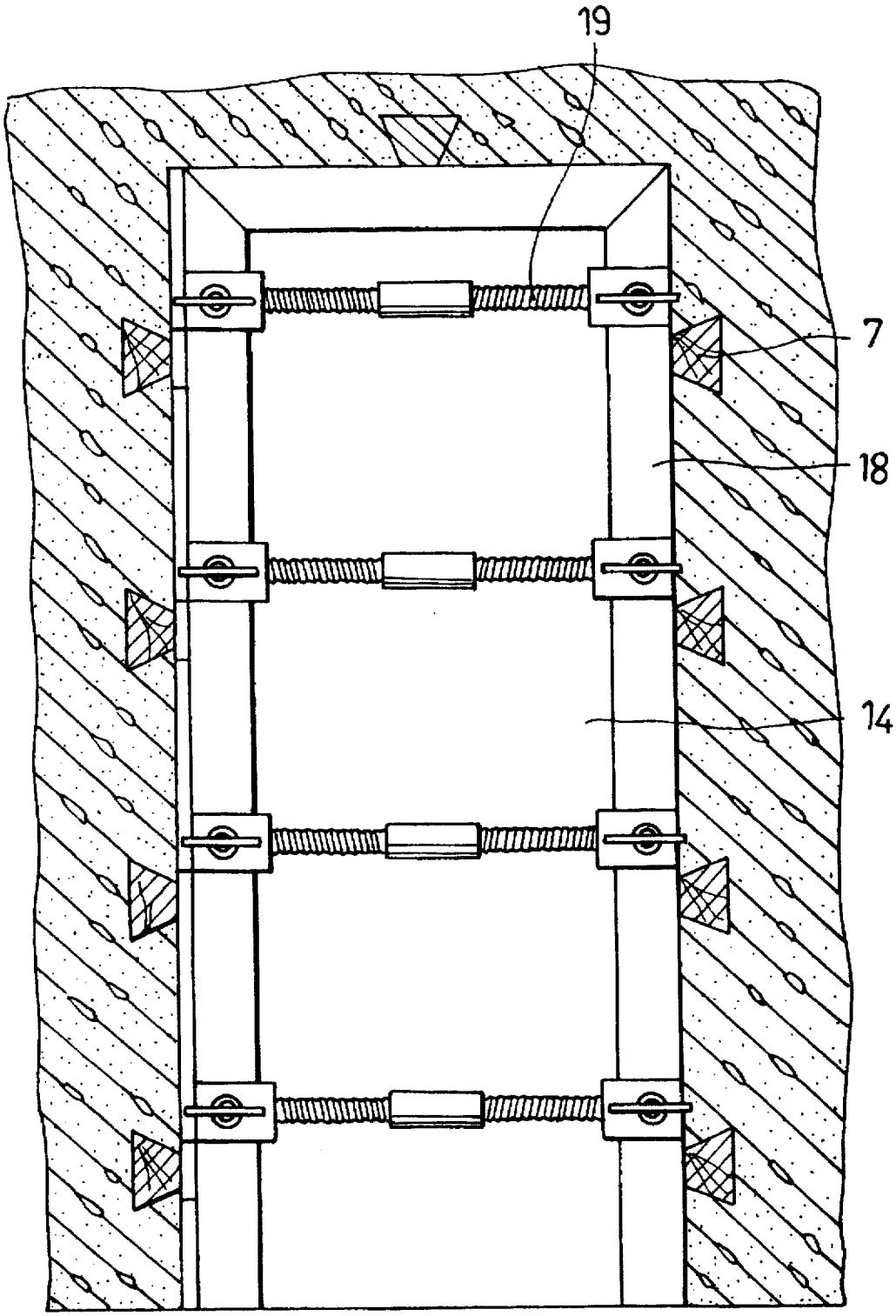
FIG. 8 is a front view illustrating the installation of a wooden door frame in a door opening formed with the use of the preferred embodiment of FIGS. 6 and 7.
Figure 9:
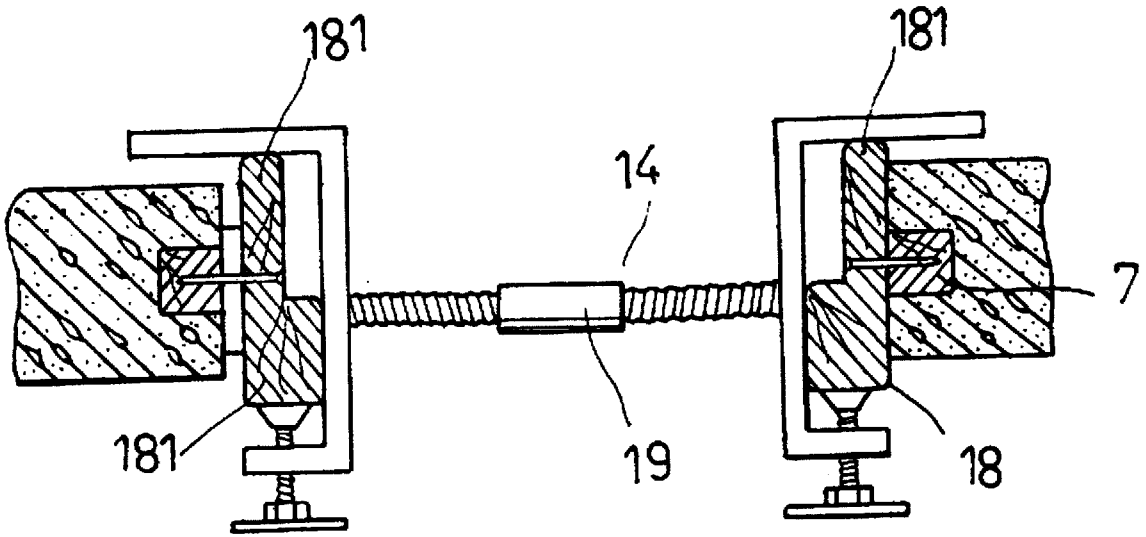
FIG. 9 is a sectional view of the concrete structure shown in FIG. 8.

Referring to FIGS. 8 and 9, a wooden door frame 18 can be installed in the door opening 14 after the formwork is stripped. A plurality of prop members 19 are provided between the vertical portions of the wooden door frame 18 to prop the door frame 18. Screws are then threaded from the door frame 18 into the positioning blocks 7 to fix the door frame 18 in the door opening 14. The prop members 19 are then removed from the door frame 18. The gaps formed between the door frame 18 and the concrete wall are patched with cement and the like.

The present invention is superior to the conventional formwork for forming a door opening in view of the following advantages: The formwork of the present invention confines an isolated door opening which is adjustable to fit the thickness of the door frame to be installed and the thickness of the concrete wall to be formed. Therefore, the formwork of the present invention can be used repeatedly at different places. This results in efficient use of the formwork. Moreover, a protruding board 181 (see FIG. 9) of the wooden door frame 18 can be fixed integrally with the wooden door frame 18 to the door opening 14, thereby eliminating the need for secondary construction, and thus decreasing the cost. Since the door frame is installed after the door opening has been formed in the concrete wall, the door frame will not twist or deform due to rain or concrete pouring, thereby obviating the need for extra treatment to protect the door frame during the construction of the concrete wall. With the use of the formwork of the present invention, an early expense for the purchase of the door frame will not be necessary.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A formwork adapted to be used with a wall form assembly which includes a parallel pair of spaced wall form plates that confine a concrete pouring space for forming a concrete wall therebetween, said formwork to be disposed between the wall form plates so as to form a door opening in the concrete wall, said formwork comprising:

a parallel pair of spaced mold frame members, each of which is adapted to be secured to a respective one of the wall form plates of the wall form assembly; and each of said mold frame members having a peripheral portion provided with a partition plate that extends toward the other one of said mold frame members, said partition plates of said mold frame members overlapping one another and being in sealing contact with each other, said partition plates being movable with said mold frame members towards and away from each other, said partition plates confining the door opening which is isolated from the concrete pouring space.

2. The formwork according to claim 1, wherein each of said mold frame members is formed with a plurality of horizontally extending slots, said formwork further comprising a plurality of bolts passing through said slots for securing said mold frame members to the wall form plates.

3. The formwork according to claim 1, further comprising at least one guide unit disposed between said mold frame members, said guide unit including a tubular sleeve having one end mounted to one of said mold frame members, and a shaft having one end mounted to the other one of said mold frame members and an opposite end extending slidably into said tubular sleeve to guide movement of said mold frame members towards and away from each other.

4. The formwork according to claim 1, wherein each of said mold frame members includes two vertical panels, each of which has a top end formed with an extension, said extension of one of said vertical panels extending toward said extension of the other one of said vertical panels, each of said mold frame members further including a horizontal panel disposed between and connected removably to said extensions of said vertical panels.

5. The form work according to claim 4, wherein each of said extensions has an inclined edge in contact with said horizontal panel, said horizontal panel being substantially trapezoid in shape and having a narrower top end, a wider bottom end, and inclined sides which complement said inclined edges of said extensions.

6. The formwork according to claim 4, wherein each of said vertical panels has an inclined bottom edge, said formwork further comprising two pairs of wedge members, each pair of said wedge members supporting said bottom edges of said vertical panels of one of said mold frame members thereon.

7. The formwork according to claim 6, wherein each of said wedge members has a bottom side provided with a seal strip.

8. The formwork according to claim 6, further comprising an externally threaded rod having one end abutting against one of said wedge members, and an internally threaded elongated socket having one end abutting against the other one of said wedge members, said rod extending threadedly into said socket and cooperating with said socket so as to prevent movement of said wedge members toward each other.

9. The formwork according to claim 1, further comprising a seal strip between said partition plates of said mold frame members.

10. The formwork according to claim 1, wherein said peripheral portion of said mold frame member is provided with a seal strip which is adapted to contact sealingly the respective one of the wall form plates.

11. The formwork according to claim 1, further comprising a plurality of projecting mold members fixed to an outer one of said partition plates of said mold frame members to form a plurality of cavities in the concrete wall for retaining fastening members which are to be used in subsequent installation of a door frame in the door opening.

12. The formwork according to claim 1, further comprising a plurality of wooden positioning blocks, each of which is mounted removably to an outer one of said partition plates.

* * * * *